US005488786A

United States Patent [19]

Ratay

[11] Patent Number: 5,488,786

[45] Date of Patent: Feb. 6, 1996

[54] HIGHLY RESILIENT EVA SHOE INSOLE

[76] Inventor: Edward J. Ratay, R.D. #1, Box 198, Penn Run, Pa. 15765

[21] Appl. No.: 828,768

[22] Filed: Jan. 30, 1992

Related U.S. Application Data

[63] Continuation-in-part of Ser. No. 652,836, Feb. 8, 1991, abandoned.

[51] Int. Cl.[6] ..... A43B 13/38

[52] U.S. Cl. ..... 36/44; 36/43

[58] Field of Search ..... 36/44, 43, 102, 36/114, 25 R, 28, 30 R, 35 R, 35 A, 37, 71

[56] References Cited

U.S. PATENT DOCUMENTS

| | | | |
|---|---|---|---|
| 4,435,910 | 3/1984 | Marc | 36/44 |
| 4,633,598 | 1/1987 | Moronaga et al. | 36/44 |
| 4,800,657 | 1/1989 | Brown | 36/44 |
| 4,823,420 | 4/1989 | Bartneck | 36/44 |
| 4,823,483 | 4/1989 | Chapnick | 36/43 |
| 4,910,882 | 3/1990 | Goller | 36/44 |
| 4,930,232 | 6/1990 | Engle | 36/44 |
| 4,974,342 | 12/1990 | Nakamura | 36/44 |
| 5,068,983 | 12/1991 | Marc | 36/44 |
| 5,146,698 | 9/1992 | Tilles et al. | 36/44 |

*Primary Examiner*—Thomas P. Hilliard
*Attorney, Agent, or Firm*—Ansel M. Schwartz

[57] ABSTRACT

The present invention pertains to a resilient shoe insole. The shoe insole is comprised of a resilient material having sufficient thickness in the heel and forefoot region to allow the resilient material to act as a spring, thereby absorbing the impact of a foot and then returning at least 70% of absorbed energy to the foot thereon and providing increased lift and response to the foot and reduced $O_2$ demand in running relative to other insoles for a given activity. In a preferred embodiment, the shoe insole has a heel portion and a forefoot portion, wherein the heel portion is thicker than the forefoot portion. The heel portion is at least ⅜ inch thick and the forefoot portion is at least ¼ inch thick. In another embodiment, the base is comprised of multiple laminations of the resilient material. In another preferred embodiment, the shoe insole is comprised of a wedge-shaped heel pad comprised of a resilient material which absorbs the maximum impact of the heel of the foot and then returns 70% of absorbed energy to the heel; the heel pad is adapted to fit under a standard sockliner of an athletic shoe and is at least ⅜ inch thick. The heel pad is wedge-shaped with at least an 8° taper such that each step causes the foot to be thrust forward.

5 Claims, 10 Drawing Sheets

HIGHLY RESILIENT EVA SHOE INSOLE

This is a continuation-in-part of application Ser. No. 07/652,836, filed on Feb. 8, 1991, now abandoned.

FIELD OF THE INVENTION

The present invention generally relates to footwear and more specifically to a resilient shoe insole.

BACKGROUND OF THE INVENTION

Athletic footwear commonly is used to provide increased support and motion control to an athlete's feet. The weight and deceleration of an athlete's body during movement is transferred from the foot, through the shoe to the ground. The characteristics of this force transferral depends on the design and material of the shoe. Materials with damping tendencies act to absorb the force thereby decreasing deceleration or shock. Unfortunately, this damping action dissipates the energy of motion which decreases quickness, rebounding, etc.

The present invention describes a resilient shoe insole which acts as a spring, returning at least 70% of absorbed energy thereby providing additional lift and increased response and reduced $O_2$ demand in running.

SUMMARY OF THE INVENTION

The present invention pertains to a resilient shoe insole. The shoe insole is comprised of a resilient material such as an EVA, EVA type or silicon foam material having sufficient thickness in the heel and forefoot region to allow the resilient material to act as a spring, thereby absorbing the impact of a foot and then returning at least 70% of absorbed energy to the foot thereon and providing increased lift and response to the foot and reduced $O_2$ demand in running relative to other insoles for a given activity.

In a preferred embodiment, the shoe insole has a heel portion and a forefoot portion, wherein the heel portion is thicker than the forefoot portion. The heel portion is at least ⅜ inch thick and the forefoot portion is at least ¼ inch thick. In another embodiment, the base is comprised of multiple laminations of the resilient material.

In another preferred embodiment, the shoe insole is comprised of a wedge-shaped heel pad comprised of a resilient material which absorbs the maximum impact of the heel of the foot and then returns 70% of absorbed energy to the heel; the heel pad is adapted to fit under a standard sockliner of an athletic shoe and is at least ⅜ inch thick at its center. The heel pad has at least an 8° taper such that each step assists the foot being thrust forward from the energy returned by the pad to the foot.

In another embodiment, the shoe insole includes a first layer having a ⅜ inch thickness and sufficient resiliency to allow the first layer to act as a spring, thereby returning at least 70% of the energy applied to it. A second more durable layer is added to the first layer to provide increased wear resistance. The second layer can be disposed on top or below the first layer.

The invention is also a method of manufacturing a shoe insole. The method includes a first step of heating the resilient layer until it becomes plastically deformable. Then, there is the step of heating the durable layer which has a contoured surface. Next, there is the step of pressing the resilient layer onto the contoured durable layer, such that the resilient layer essentially forms to the contoured surface and is bonded to it.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1B:
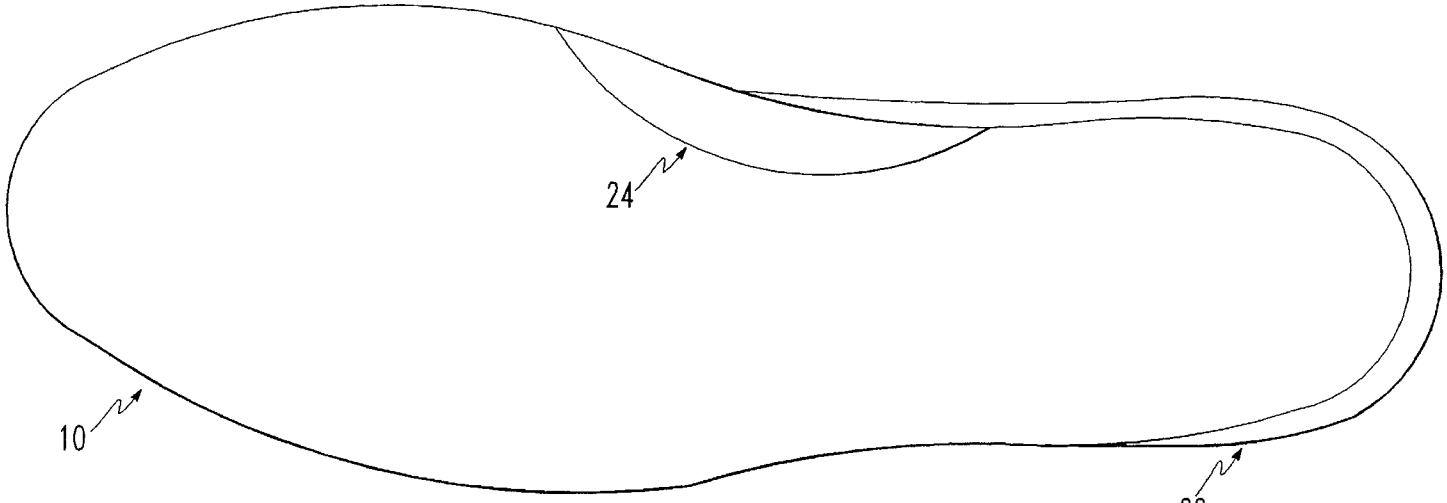
FIGS. 1A and 1B are schematic representations of the side and top view of the shoe insole.
Figure 1A:
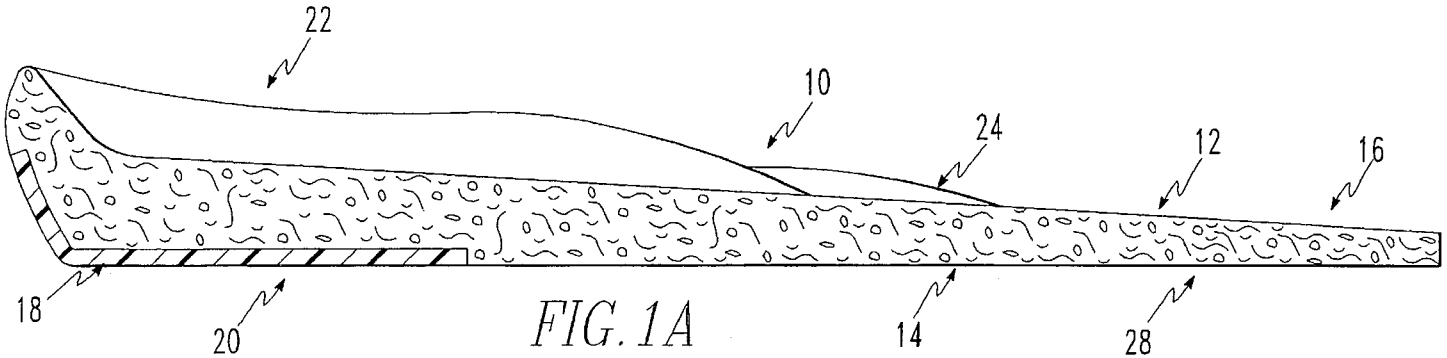

Referring now to the drawings wherein like reference numerals refer to similar or identical parts throughout the several views, and more specifically to FIGS. 1A and 1B thereof, there is shown a schematic representation of a shoe insole 10. The base 12 is comprised of EVA, EVA type or silicon based foam material 14 which acts like a spring, thereby absorbing the maximum impact of the heel and forefoot during compression and then returning at least 70% of the absorbed energy to the foot for increased lift and response. EVA stands for ethylene vinyl acetate. The heel portion 20 of the base 12 layer has a thickness of at least ⅜ inch while the forefoot portion 28 of the base 12 has a thickness of at least ¼ inch. The increased thickness of the rear portion of the base 12 is due to the fact that the heel typically transmits a larger force to the insole 10 than the forefoot in typical athletic motion. It is the thickness of the heel that affords the desired results.

Preferably, a fabric 16 is disposed on the upper surface of base 12 for providing enhanced surface features such as a smooth surface and increased wear resistance.

Figure 5:
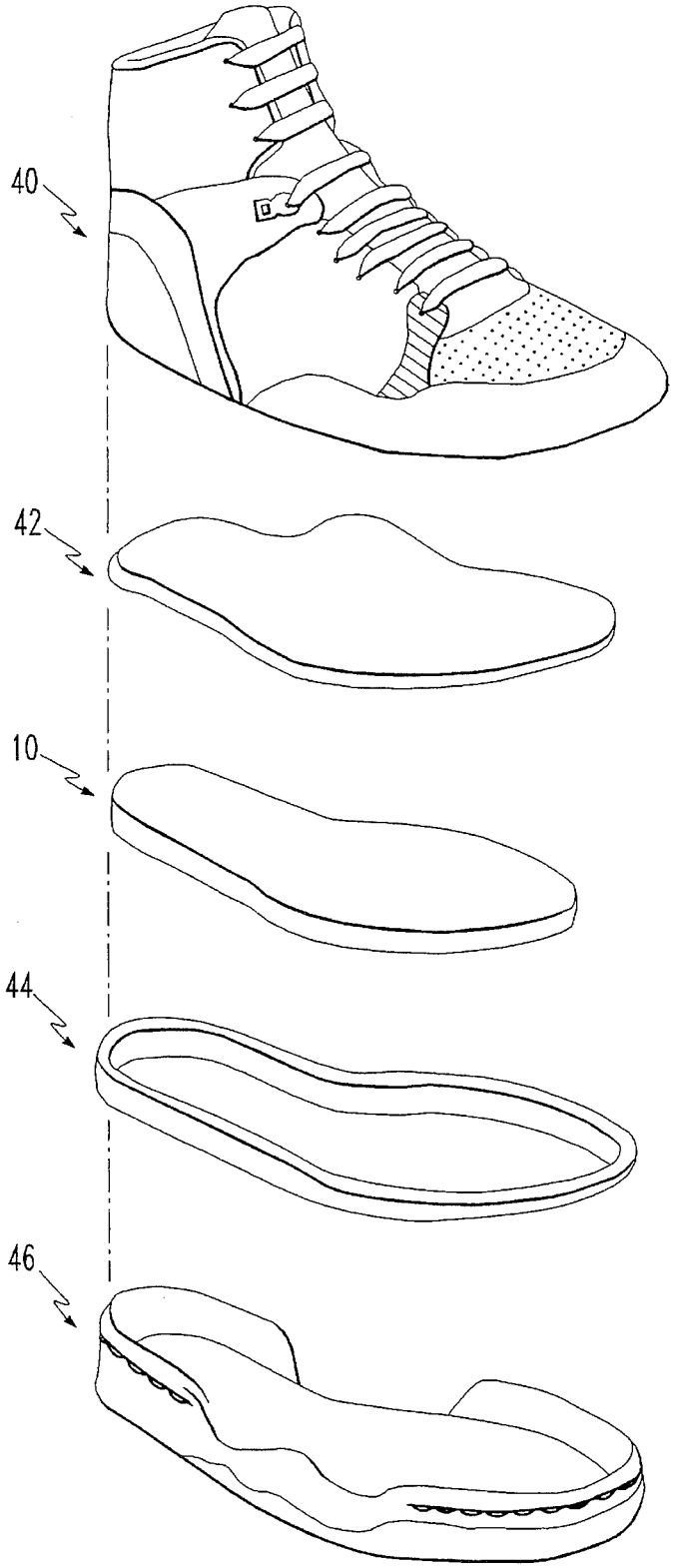
FIG. 5 is a schematic representation of an exploded view of the shoe insole in relationship to an athletic shoe.

The base 12 of shoe insole 10 is further comprised of heel cup 18 which is disposed on the lower part of heel portion 20. Preferably, the heel cup 18 is preferably made of hard plastic which acts to support the resilient material 14 thereby inhibiting deformation due to the compressive forces of the heel and forefoot during athletic activity. Preferably, a cupped back 22 is disposed on the heel portion 20 of base 12 and is adapted to conform to the heel structure of the foot. Cupped back 22 is preferably comprised of a material, such as plastic, which supports the heel adequately to prevent excessive heel movement. Preferably, a side crown 24 is disposed on the side of the insole 10 corresponding to the arch of the foot. Side crown 24 is adapted to support the arch of the foot in a neutral or unextended position during athletic activities. FIG. 5 shows the relationship of the insole 12 to the rest of an athletic shoe, upper 40, sockliner 42, midsole 44 and outsole 46.

The following is the test results of a pendulum impact test on various athletic shoe soles. The athletic shoes were tested with their respective standard insoles and with the resilient shoe insole 10 in place of the standard insole.

| SHOE TYPE | INSOLE TYPE | HT. DROP | HT. REBOUND | HT. DIFF. | % INCREASE |
|---|---|---|---|---|---|
| New Balance ® | Invention | 18" | 8 ⅝" | +1 ½" | 21% |
| " | New Balance | 18" | 7 ⅛" | | |
| Converse ERX ® | Invention | 18" | 8 ⅝" | +2 ⅛" | 33% |
| " 300 | Converse | 18" | 6 ½" | | |
| Puma M-50 HI ® | Invention | 18" | 8 ⅞" | +2 ⅜" | 37% |
| " | Puma | 18" | 6 ½" | | |
| Nike Air ® | Invention | 18" | 8 ⅞" | +2 ½" | 39% |
| " | Nike Air | 18" | 6 ⅜" | | |
| Pony ® | Invention | 18" | 8 ⅞" | +2 ⅝" | 42% |
| " | Pony | 18" | 6 ¼" | | |
| Reebox ERS ® | Invention | 18" | 7 ¼" | +2 ⅞" | 66% |
| " | Reebox | 18" | 4 ⅜" | | |

The test reveals a significant increase of rebound height in all cases. This translates to more energy returned to the foot during motion and reduced $O_2$ demand in running.

Figure 2:
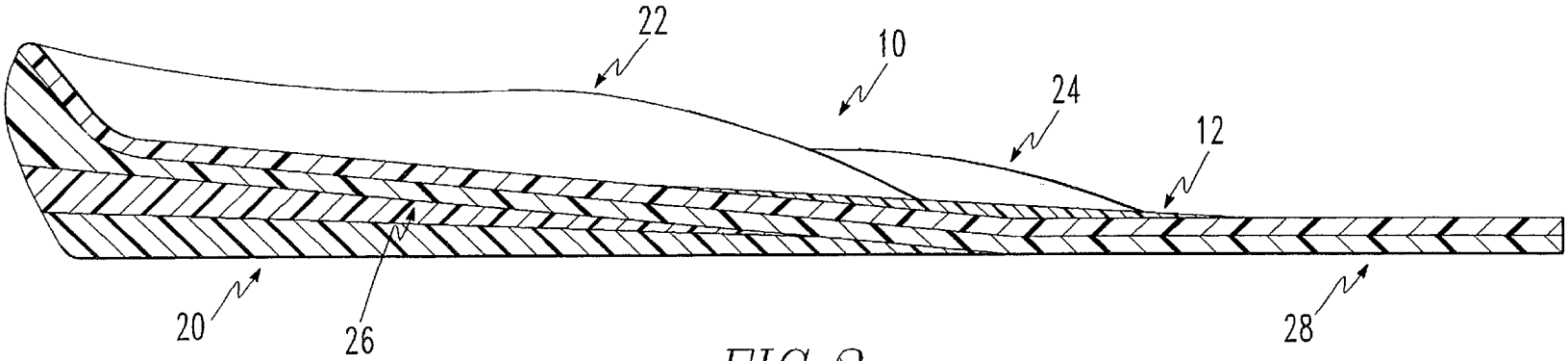
FIG. 2 is a schematic representation of a side cross section of the shoe insole with multiple laminations.

In an alternative embodiment, as shown in FIG. 2, the sole 12 of shoe insole 10 is comprised of multiple laminations 26, preferably each of which is an EVA, EVA type or silicon based foam material 14. The resilient material 14 is layered such that the heel portion 20 of base 12 is substantially thicker than that of the forefoot portion 28. Preferably, the heel portion 20 of the base 12 layer has a thickness of at least ⅜ inch at its center while the forefoot portion 28 of the base 12 has a thickness of at least ¼ inch. An adhesive is preferably used to join the multiple laminations such that the adhesive firmly joins the multiple laminations 26 while maintaining the resilient and flexible properties of the base 12.

Figure 3B:
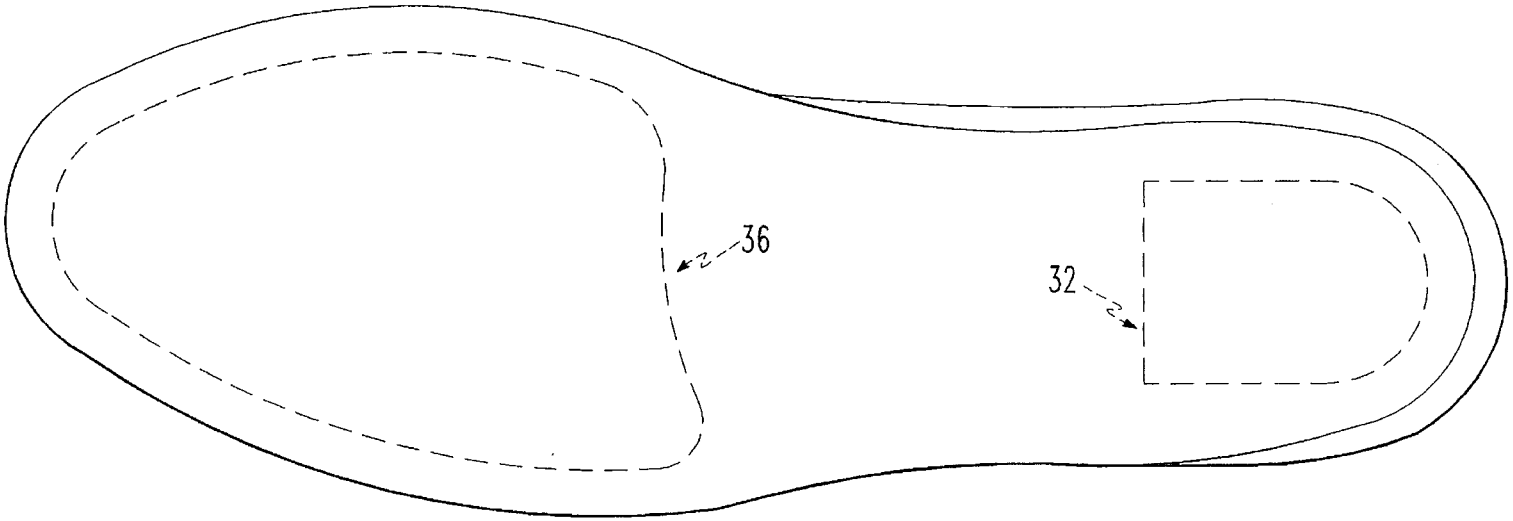
FIGS. 3A and 3B are schematic representations of the side and top views of the shoe insole with heel and forefoot inserts.
Figure 3A:
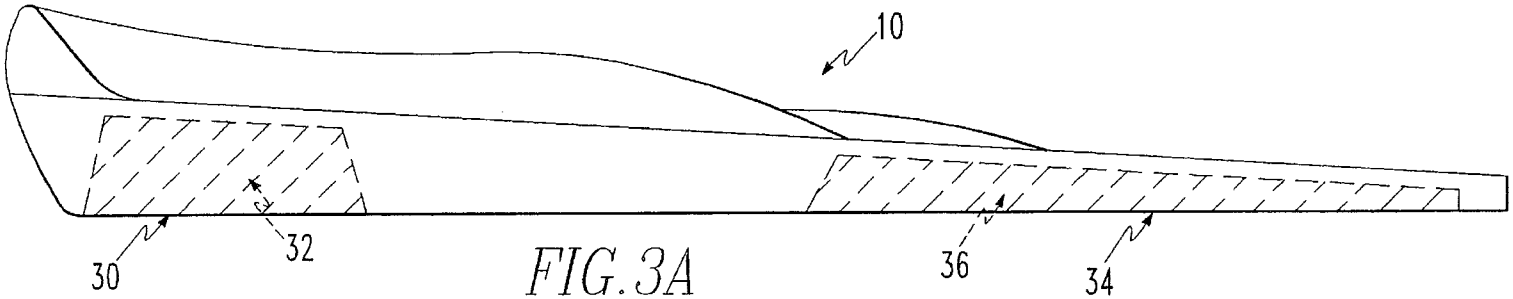

In another preferred embodiment, as shown in FIG. 3, the base 12 of shoe insole 10 includes a heel cavity 30 for accommodating a resilient insert 32 such that the heel insert 32 acts as a spring thereby absorbing maximum impact of the heel during compression and then returning at least 70% of absorbed energy to the heel of the foot for increased lift and response. If it is so desired, the base 12 of shoe insole 10 can include a forefoot cavity 34 for accommodating a resilient forefoot insert 36 such that the forefoot insert 36 acts as a spring, thereby absorbing maximum impact of the forefoot during compression and then returning at least 70% of the absorbed energy to the forefoot for increased lift and response and reduces $O_2$ demand in running. Preferably, the heel cavity 30 has a depth of ⅜ inch, allowing for a ⅜ inch thick resilient heel insert 32. The forefoot cavity 34 preferably has a thickness of ¼ of an inch allowing for a ¼ inch thick resilient forefoot insert 36.

Figure 4B:
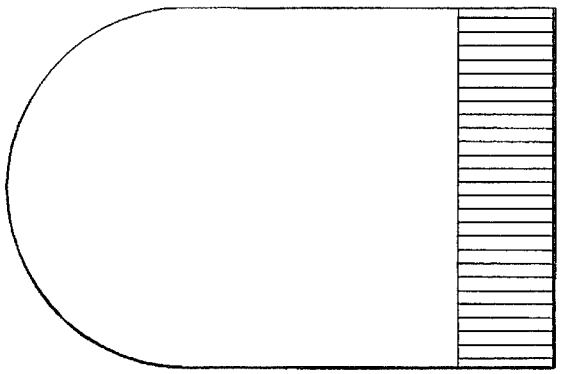
FIGS. 4A and 4B are schematic representations of the side and top views of the resilient heel wedge.
Figure 4A:
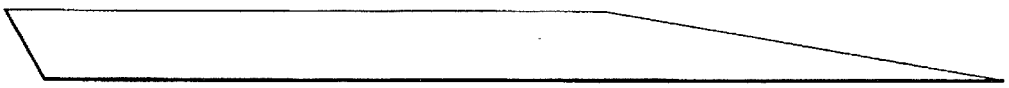

In another preferred embodiment, as shown in FIG. 4, the shoe insole 10 is comprised of a heel pad 38 which is preferably formed in the shape of a wedge which is adapted to fit in the heel portion of a shoe as shown in FIG. 4. The heel pad 38 is adapted to fit under a standard sockliner 42 of a shoe and is comprised of a the material 14 which absorbs the impact of a heel strike and then returns at least 70% of absorbed energy to the heel of the foot for increased lift and response and reduces the $O_2$ consumption in running.

Figure 6:
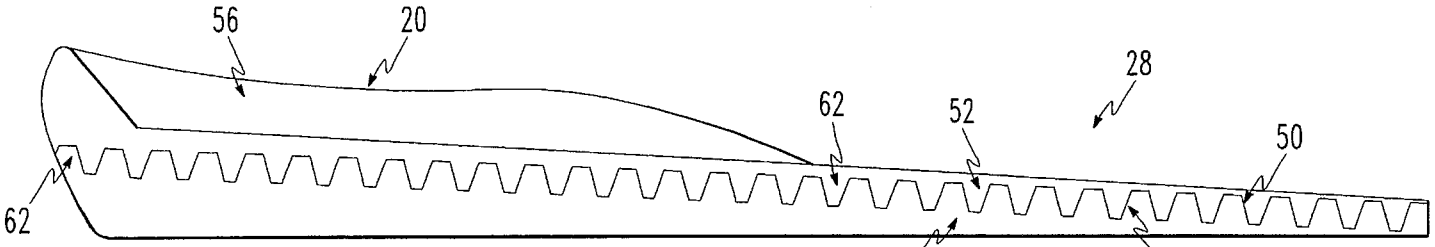
FIG. 6 is a schematic representation of the shoe insole having the first resilient layer disposed below the second durable layer.

In an alternative embodiment and as shown in FIG. 6, the shoe insole 10 is comprised of a first layer 48 comprised of a EVA, EVA type or silicon based foam material having sufficient resiliency to allow the material to act as a spring, thereby returning at least 70% of the energy applied to it. A first mating surface 50 is formed on the first layer 48. The shoe insole 10 also comprises a second layer 52 which is comprised of a second material such as a waffle material. The second material has less resiliency and greater durometer than the first material. The second layer 52 has a second mating surface 54. The first and second layers 48, 52 are integrally connected along the first and second mating surfaces 50, 54 such that they essentially do not slide relative to each other. The connected layers, as a combination, return at least 65% of the energy applied to them. Preferably, the mating surfaces are contoured in a frustrum pattern. Preferably, at least one of the layers has a contoured surface 56 to receive a foot.

Figure 8:
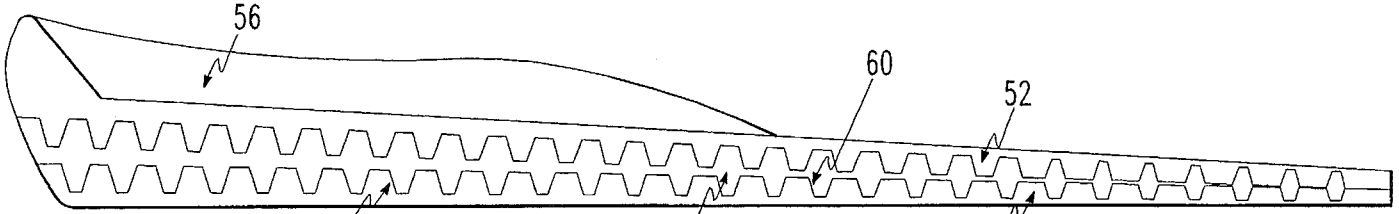
FIG. 8 is a schematic representation of the shoe insole having the first resilient layer sandwiched between the two durable layers.

In a preferred embodiment and as shown in FIG. 8, the shoe insole 10 is comprised of a third layer 58 which is comprised of the second material The third layer 58 has a third mating surface 59. In this case, the first layer 48 has a fourth mating surface 60. The first and third layers 58 are integrally connected along the third and fourth mating surfaces 59, 60 such that the resilient first layer 48 is essentially sandwiched between the second and third layers 52, 58.

Figure 7:
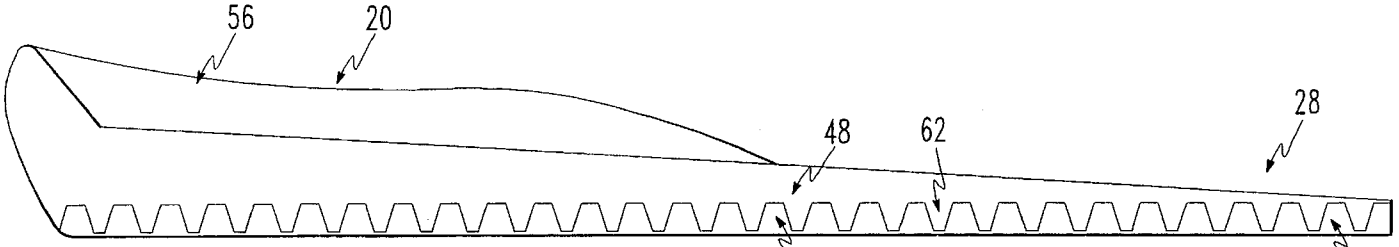
FIG. 7 is a schematic representation of the shoe insole having the first resilient layer disposed above the second durable layer.

Preferably, as shown in FIG. 6, the first layer 48 is disposed below the second layer 52. The second layer 32 therefore has the contoured surface 56 for receiving the foot. Alternatively, as shown in FIG. 7, the second layer 52 is disposed below the first layer 48. In this case, the first layer 48 has the contoured surface 56 for receiving the foot.

Preferably, the frustrum pattern is formed from an array of tapered projections 62 having square bases. The bases have sides measuring ¼". The tapered projections 62 interlock with each other to integrally connect the two layers.

A method is also disclosed for forming the interlocking layers of the shoe insole 10. The method comprises the step of first heating a first layer comprised of a first material. The first material, at ambient temperatures has a desired durometer and has sufficient resiliency to allow the first layer to act as a spring, thereby returning at least 70% of the energy applied to it. The first material becomes plastically deformable upon heating. EVA is a suitable first material. Next, there is the step of heating a second layer. The second layer is comprised of a second material. The second material has essentially less resiliency and a greater durometer than the first material. The second layer has a contoured mating surface which retains its shape during heating. Then, there is the step of pressing the first layer onto the contoured surface of the second layer such that the first layer forms to the shape of the contoured surface and is bonded to it. Finally, there is the step of cooling the layers.

Figure 9A:
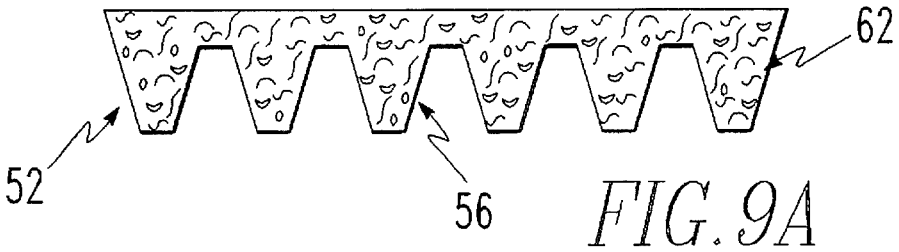
FIGS. 9A and 9B are schematic representations of the cross sectional and top views of the contoured second layer formed in a frustrum pattern.
Figure 9B:
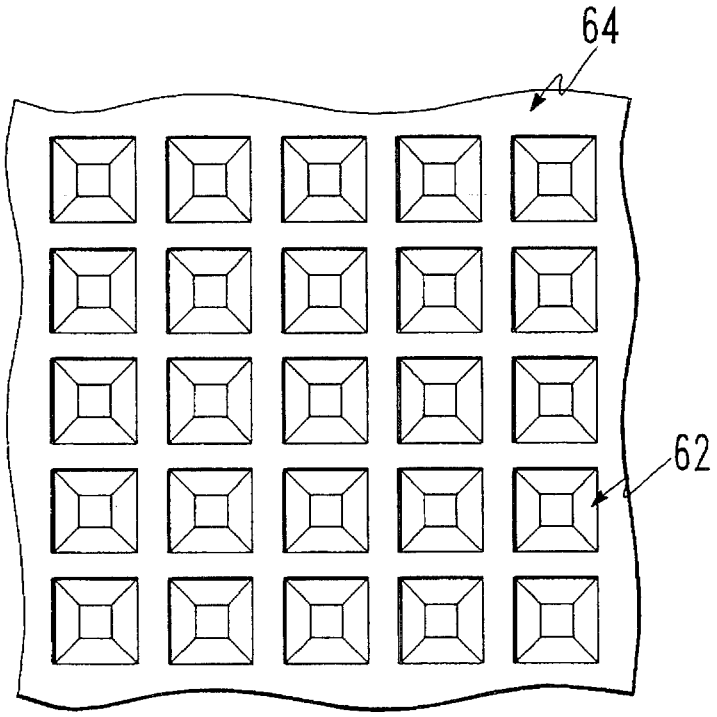

Preferably, and as shown in FIGS. 9A and 9B, the contoured surface 56 of the second layer 52 is formed in a frustrum pattern. Preferably, the frustrum pattern is formed from an array 64 of tapered projections 62.

Figure 10:
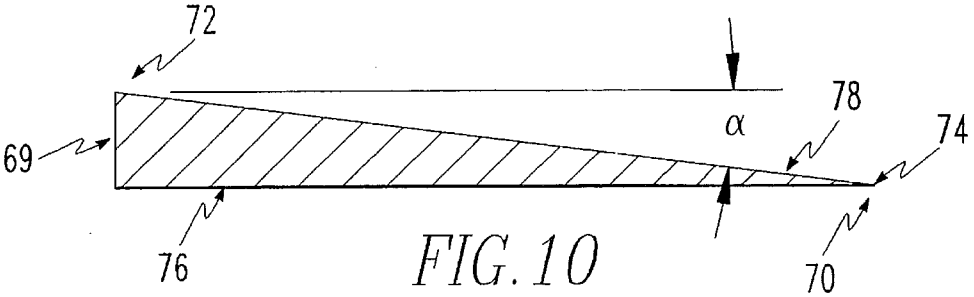
FIG. 10 is a schematic representation showing a cross sectional side view of the wedge-shaped heel pad.

As shown in FIG. 10, the shoe insole 10 is comprised of a wedge-shaped heel pad 69 comprised of EVA, EVA type or silicon based foam material having sufficient resiliency to absorb energy resulting from the impact of a foot and then return at least 70% of absorbed energy to the foot resulting in reduced $O_2$ demand in running relative to other insoles for a given activity. The heel pad 69 has a rear end 72, a front end 74, a bottom surface 76 and a top surface 78. The top surface 78 tapers from the rear end 72 to the front end 74 at an angle $\alpha$ of at least 8° but not greater than 30° with respect to the bottom surface 76. Preferably, the thickness of the wedge-shaped heel pad 69 midway between the front and rear end is at least ⅜ inch. The wedge-shaped heel pad 69, for example, is ⅝ inch thick at its rear end 72, essentially 0 inch thick at the tip of the front end 74 and is 3 inches long.

The advantage of the wedge-shaped heel pad 69 having the angle $\alpha$ is that it pushes the foot in a forward direction rather than a vertical direction when it returns energy to the foot. Since the user is moving in a forward direction, the energy returned to the foot has some component which is in the plane of movement, thus assisting the user in moving in the desired direction. During a step, the foot of the user comes down on the ground with the edge of the heel first. The heel rolls forward as the weight and body of the user moves forward, the whole time of which compression is occurring to the wedge-shaped heel pad 69. When the weight and body of the user is essentially over the center of the foot, compression of the wedge-shaped heel pad 69 is essentially complete and the foot is flat except for the heel which is essentially at the angle $\alpha$ of the pad 69. As the weight of the user continues forward, the pad begins and then continues to release energy to the user's foot as the foot moves off the pad 69 to prepare for the next step. At least some component of energy from the pad 69 is provided to user in the direction of movement. This facilitates the user to move in that direction, thus saving the user energy.

Figure 11:
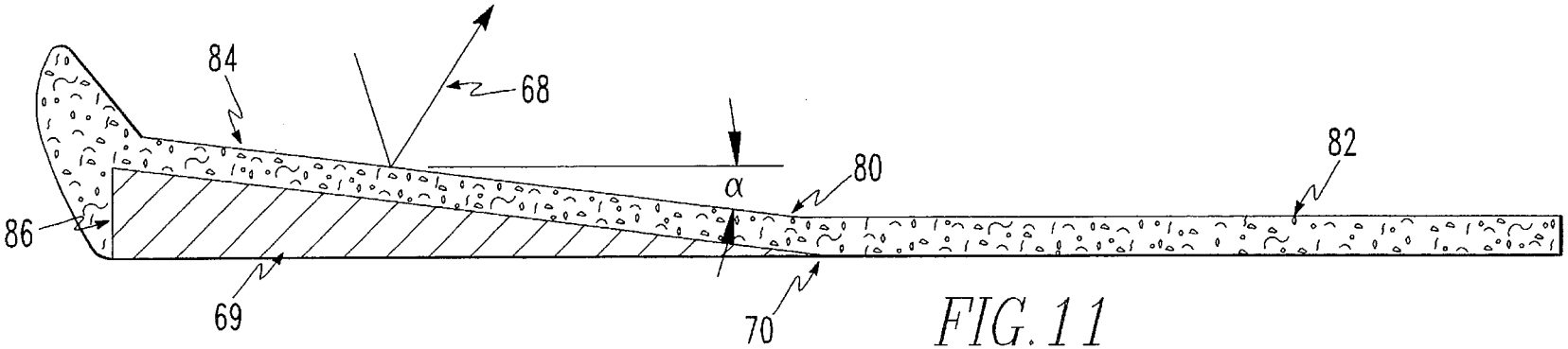
FIG. 11 is a schematic representation showing a first embodiment of the wedge-shaped heel pad disposed within the base.

In a preferred embodiment and as shown in FIG. 11, the wedge-shaped heel pad 69 is disposed in a base 80 having a forefoot portion 82 and a heel portion 84. The heel portion 84 has a wedge-shaped cavity 86 within which the wedge-shaped heel pad 69 is disposed. Preferably, the base 80 has a cupped back 22 for accommodating the heel of the foot. The base 80 is preferably made of a silicon based foam material which is softer than the material of which the wedge is made. The base provides a cushioning effect to the user, since the pad 69 is harder. Essentially, any material which is softer than the pad 69 material can be used for the base 80 material. The base 80 also serves to level out the interface between the heel and forefoot position.

Figure 12:
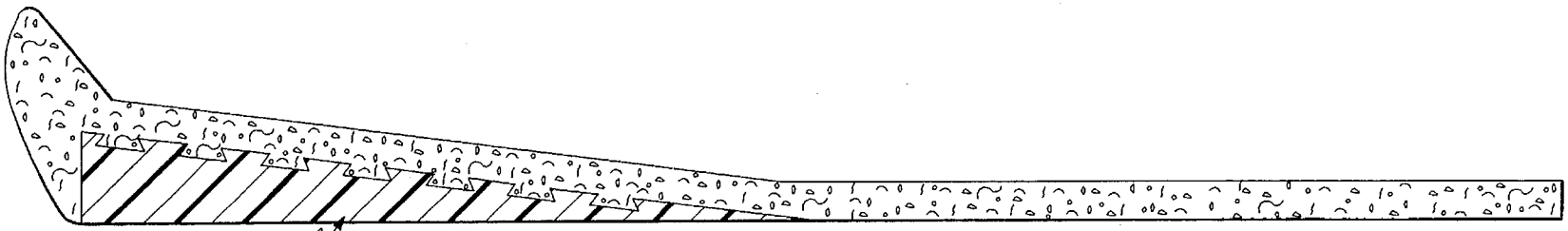
FIG. 12 is a schematic representation showing a second embodiment of the wedge-shaped heel pad disposed within the base.
Figure 13:
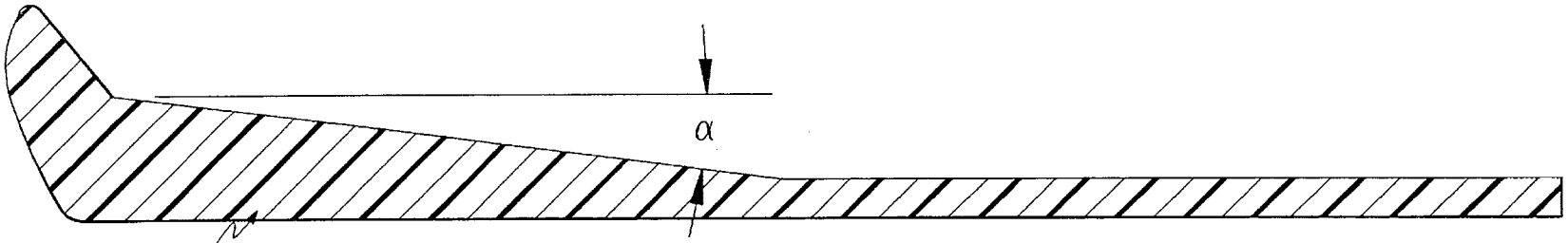
FIG. 13 is a schematic representation showing a wedge-shaped shoe insole.
Figure 14:
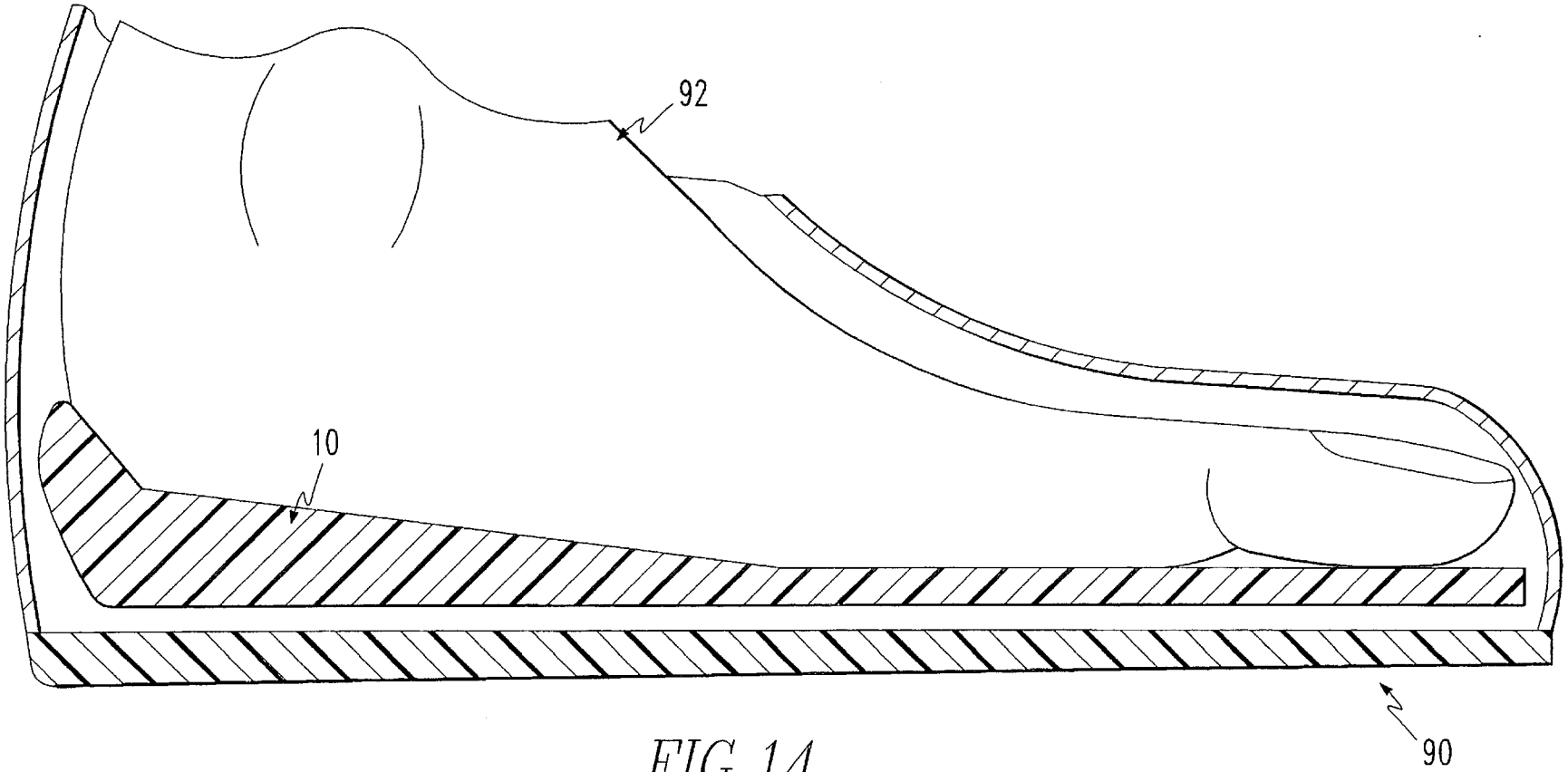
FIG. 14 is a schematic representation showing the shoe insole in a relationship to an athletic shoe and foot.

As shown in FIG. 12, the wedge-shaped heel pad 69 can be fixedly attached within the cavity 86 with an interlocking frustrum pattern as described previously. Alternatively, as shown in FIG. 13, the wedge-shaped heel pad 69 extends to form a complete insole which is comprised entirely of EVA, EVA type or silicon based foam material. FIG. 14 shows the insole 10 in relationship to an athletic shoe 90 and foot 92.

The following are the test results which show that the thickness of the EVA type material 14 is important in determining the percentage of energy return. A steel ball was dropped onto the EVA material from a height of 24 inches and its rebound height measured.

| Thickness | Rebound | % Energy Return |
|---|---|---|
| ⅛" | 8" | 33% |
| ¼" | 11" | 46% |
| ⅜" | 18" | 75% |
| ½" | 19" | 79% |

Accordingly, the resilient material should have a thickness of at least ⅜" to return 70% of the energy applied to it.

It has been shown in practice that the optimal compression deflection rate (CDR) of the resilient material is determined by the user's bodyweight. The following shows the optimum CDR for a range of weights.

| lbs. | 90–115 | 116–135 | 136–155 | 156–185 | 186–205 | 205–240 |
|---|---|---|---|---|---|---|
| CDR | 2 | 5 | 9 | 14 | 18 | 23 |

What this table illustrates is that the higher the CDR, the firmer the material. For the values identified, to achieve a 50% compression rate (for instance, a 1-inch thick piece to be compressed to 0.5 inch thick) with an assumed ⅝ inch round foot requires a force of 4.75 lbs., 5.50 lbs., 6.50 lbs., 8.60 lbs. and 9.75 lbs. concerning the respective CDR values identified.

The shoe insole as shown in FIG. 11 was tested against the standard insole of a given shoe. The test was conducted on a treadmill in 4 stages. Walking at 3 mph, slow jogging at 5 mph, jogging at 6 mph and running at 7.5 mph. There were three minutes per stage. The following test results clearly show the rate of oxygen consumption was drastically less when the resilient shoe insole 10 is used in place of the standard insole.

| Test #1 (Pony ® Hi-Tops) | | | Test #2 (Avia ® 2050) | | |
|---|---|---|---|---|---|
| | $O_2$ L/min. | | | $O_2$ L/min. | |
| Time | Invention | Standard | Time | Invention | Standard |
| :32 | .53 | .76 | :33 | .61 | .89 |
| 1:02 | .59 | .77 | 1:30 | .67 | .95 |
| 2:01 | .54 | .74 | 2:03 | .61 | .92 |
| 3:01 | .54 | .72 | 3:02 | .60 | .88 |
| 5:01 | 1.42 | 1.84 | 5:02 | 1.59 | 2.23 |
| 6:01 | 1.26 | 1.84 | 6:01 | 1.78 | 2.38 |
| 7:03 | 1.56 | 1.92 | 7:01 | 1.85 | 2.64 |

-continued

| | | | | | |
|---|---|---|---|---|---|
| 9:02 | 1.65 | 2.00 | 9:01 | 2.10 | 2.86 |
| 11:31 | 1.99 | 2.63 | 11:30 | 2.51 | 3.39 |
| 12:02 | 2.01 | 2.63 | 12:03 | 2.58 | 3.76 |

| Test #3 (Saucony ®) | | | Test #4 (Aisics ®) | | |
|---|---|---|---|---|---|
| | $O_2$ L/min. | | | $O_2$ L/min. | |
| Time | Invention | Standard | Time | Invention | Standard |
| :30 | .66 | .74 | :30 | .61 | .81 |
| 2:30 | .70 | .83 | 2:31 | .65 | .80 |
| 3:00 | .68 | .70 | 3:02 | .67 | .81 |
| 3:30 | .92 | 1.12 | 3:33 | 1.03 | 1.09 |
| 4:31 | 1.76 | 2.04 | 6:02 | 1.57 | 1.72 |
| 5:31 | 1.64 | 2.00 | 8:01 | 1.98 | 2.12 |
| 6:31 | 1.82 | 2.04 | 9:01 | 1.91 | 2.14 |
| 7:01 | 2.03 | 2.40 | 11:02 | 2.34 | 2.62 |
| 11:00 | 2.62 | 2.89 | 11:32 | 2.39 | 2.60 |
| 12:01 | 2.60 | 2.93 | 12:03 | 2.52 | 2.60 |

Test #1 shows an average $O_2$ savings of 25%.
Test #2 shows an average $O_2$ savings of 26%.
Test #3 shows an average $O_2$ savings of 11%.
Test #4 shows an average $O_2$ savings of 10 ½%.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A shoe insole comprising:

a wedge-shaped heel pad comprised of ethylene vinyl acetate, or silicone based foam having sufficient resiliency to absorb energy resulting from the impact of a foot and then returning at least 70% of absorbed energy to the foot, said pad having a bottom surface, a top surface, a front end and a rear end, said top surface tapers from the rear end to the front end at a constant angle of at least 8° with respect to the bottom surface.

2. A shoe insole as described in claim 1 wherein the thickness of the heel pad essentially midway between the front end and the rear end is at least ⅜ inch.

3. A shoe insole as described in claim 1 including a base having a forefoot portion and a heel portion, said heel portion having a wedge-shaped cavity within which the heel pad is disposed.

4. A shoe insole as described in claim 3 wherein the heel pad is fixedly disposed within said cavity.

5. A shoe insole as described in claim 4 wherein the base has a cupped back for accommodating the heel of the foot.

* * * * *